US009637862B2

(12) United States Patent
Saas et al.

(10) Patent No.: US 9,637,862 B2
(45) Date of Patent: May 2, 2017

(54) HYBRID MULTI-PLY TISSUE PAPER PRODUCT AND METHOD FOR MANUFACTURING THE SAME

(71) Applicant: SCA TISSUE FRANCE, Saint-Ouen (FR)

(72) Inventors: Pascale Saas, Kirchheim bei München (DE); Sébastien Jeannot, Holtzwihr (FR)

(73) Assignee: SCA TISSUE FRANCE, Saint-Ouen (FR)

( * ) Notice: Subject to any disclaimer, the term of this patent is extended or adjusted under 35 U.S.C. 154(b) by 0 days.

(21) Appl. No.: 14/400,694

(22) PCT Filed: Apr. 29, 2013

(86) PCT No.: PCT/IB2013/000787
§ 371 (c)(1),
(2) Date: Nov. 12, 2014

(87) PCT Pub. No.: WO2013/179109
PCT Pub. Date: Dec. 5, 2013

(65) Prior Publication Data

US 2015/0184342 A1 Jul. 2, 2015

(30) Foreign Application Priority Data

May 14, 2012 (EP) ..... 12003812

(51) Int. Cl.
*B31F 1/07* (2006.01)
*B31F 1/12* (2006.01)
(Continued)

(52) U.S. Cl.
CPC ..... *D21F 11/006* (2013.01); *B31F 1/07* (2013.01); *D21H 1/02* (2013.01);
(Continued)

(58) Field of Classification Search
CPC ..... D21H 1/02; D21H 27/30; D21H 27/32; D21H 27/38; D21H 27/40; B31F 1/07;
(Continued)

(56) References Cited

U.S. PATENT DOCUMENTS 4,100,017 A 7/1978 Flautt, Jr.
5,695,607 A * 12/1997 Oriaran ..... D21F 9/006 162/112
(Continued)

FOREIGN PATENT DOCUMENTS

CN 1391626 A 1/2003
EP 2 353 859 A1 8/2011
(Continued)

OTHER PUBLICATIONS

Notification of First Office Action issued Feb. 15, 2016 in Chinese Patent Application No. 201380025204.4 (7 pages) with an English Translation (8 pages).

*Primary Examiner* — Jose Fortuna
(74) *Attorney, Agent, or Firm* — Drinker Biddle & Reath LLP

(57) ABSTRACT

A hybrid multi-ply tissue paper product comprising at least three plies made of tissue paper base-sheet is described. At least one ply is a structured ply produced by a structuring manufacturing method. The structured ply includes a structured back face. At least another ply is a wet pressed ply produced by a wet press manufacturing method. The structured ply is positioned and orientated with respect to the at least two other plies such that the structured back face of the structured ply is facing the at least two other plies so as to dampen a two-sidedness effect related to the structured back face.

15 Claims, 4 Drawing Sheets

(51) Int. Cl.
*D21H 27/40* (2006.01)
*D21F 11/00* (2006.01)
*D21H 27/30* (2006.01)

(52) U.S. Cl.
CPC ..... *B31F 2201/0738* (2013.01); *B31F 2201/0756* (2013.01); *B31F 2201/0761* (2013.01); *B31F 2201/0787* (2013.01)

(58) Field of Classification Search
CPC ..... B31F 2201/0738; B31F 2201/0756; B31F 2201/0761; B31F 2201/0787; B31F 1/12; D21F 11/006
See application file for complete search history.

(56) References Cited

U.S. PATENT DOCUMENTS 5,830,558 A 11/1998 Barnholtz
5,851,629 A * 12/1998 Oriaran ..... D21F 9/006 428/153
6,176,972 B1 * 1/2001 Oriaran ..... D21F 11/006 162/111
6,207,013 B1 * 3/2001 Oriaran ..... D21F 11/006 162/111
6,699,360 B2 * 3/2004 Heath ..... B31F 1/07 162/111
6,896,768 B2 * 5/2005 Dwiggins ..... B31F 1/07 156/209
7,497,923 B2 3/2009 Ward et al.
7,662,256 B2 * 2/2010 Hermans ..... D21H 27/005 162/112
8,246,885 B2 * 8/2012 Jeannot ..... B31F 1/07 156/209
2004/0238135 A1 * 12/2004 Edwards ..... D21F 11/006 162/111
2005/0045293 A1 * 3/2005 Hermans ..... D21H 19/10 162/109
2007/0042209 A1 * 2/2007 Morin ..... B31F 1/07 428/537.5
2008/0073047 A1 * 3/2008 Bakken ..... D21F 1/0054 162/116
2009/0057951 A1 * 3/2009 Wegele ..... B31F 1/07 264/284
2009/0065160 A1 * 3/2009 Hermans ..... D21H 27/005 162/112
2009/0162597 A1 6/2009 Barredo et al.
2009/0294079 A1 * 12/2009 Edwards ..... D21F 11/006 162/100
2013/0344294 A1 * 12/2013 Eilert ..... B31F 1/07 428/172
2014/0117135 A1 * 5/2014 Graff ..... A47K 10/16 242/159
2015/0184342 A1 * 7/2015 Saas ..... B31F 1/07 162/132
2015/0225903 A1 * 8/2015 Jeannot ..... B31F 1/07 162/132
2016/0002861 A1 * 1/2016 Goulet ..... D21H 11/04 162/111

FOREIGN PATENT DOCUMENTS

FR 2906183 A1 * 3/2008 ..... B31F 1/07
FR WO 2013179109 A3 * 3/2014 ..... B31F 1/07
FR EP 2664451 B1 * 12/2014 ..... B31F 1/07
WO WO-01/38640 A1 5/2001
WO WO 2007080322 A2 * 7/2007 ..... B31F 1/07

* cited by examiner

HYBRID MULTI-PLY TISSUE PAPER PRODUCT AND METHOD FOR MANUFACTURING THE SAME

CROSS-REFERENCE TO PRIOR APPLICATION

This application is a §371 National Stage Application of PCT International Application No. PCT/IB2013/000787 filed Apr. 29, 2013, which claims priority to EP 12003812.0, filed May 14, 2012, both of which are incorporated by reference herein in their entirety.

TECHNICAL FIELD

An aspect relates to a hybrid multi-ply tissue paper product. Another aspect relates to a method for manufacturing a hybrid multi-ply tissue paper product. Such a hybrid multi-ply tissue paper product finds a particular, though non-exclusive, application in the tissue paper industry. Tissue paper may be used for sanitary or domestic purposes. As an example, a web of tissue paper is wound onto a core for the purpose of manufacturing paper towel, toilet tissue rolls, facial rolls, bathroom tissue, wiping tissue or kitchen tissue rolls. As another example, a web of tissue paper is folded for the purpose of manufacturing facial tissue, handkerchiefs or bathroom tissue.

BACKGROUND

In the following, a tissue paper product relates to an absorbent paper based on cellulose wadding which is also called tissue paper base-sheet in this field of technology. A typical absorbent paper has a low basis weight, in the range from 10 to 45 g/m$^2$.

The tissue paper can be produced from paper fibers according to the Conventional Wet Press (CWP) manufacturing method, or by the Through Air Drying (TAD) manufacturing method, or any alternative manufacturing method (e.g. Advanced Tissue Molding System ATMOS of the company Voith, or Energy Efficient Technologically Advanced Drying eTAD of the company Georgia Pacific). The paper fibers can be produced from virgin and/or recycled paper pulp raw material.

The CWP manufacturing method includes the steps of:

- pressing and drying the wet paper fibers as a sheet on a large-diameter, heated cylinder (also called Yankee dryer); and
- subsequently detaching and creping the sheet of dried paper fibers by means of a metal blade applied against said cylinder, across its direction of rotation.

The creping operation creates undulations in the sheet across its direction of travel. The creping operation increases the thickness of the sheet, and confers elasticity and gives touch properties to the sheet.

The TAD manufacturing method includes the steps of:

- molding the sheet of wet paper fibers on a fabric; and
- subsequently drying the sheet, at least partly, by means of a current of hot air passing through it.

Subsequently, the dried sheet may be creped.

Once, the tissue paper has been manufactured, a distinct manufacturing operation called converting operation is necessary to form the end product (i.e. the paper towel, toilet tissue rolls, bathroom tissue, wiping tissue, kitchen tissue rolls, handkerchiefs, etc . . . ). During the converting operation, several of such sheets, also called plies, can be combined to form said end product.

It is possible to combine several plies together to confer particular properties on a sheet such as thickness, softness, and bulkiness.

Several plies may be combined together by a combining operation of a chemical nature (e.g. by adhesive bonding), or of a mechanical nature (e.g. by knurling or embossing), or a combination of both. During adhesive bonding, a film of adhesive is deposited over some or all of the surface of one of the plies, then the adhesive-treated surface is placed in contact with the surface of at least one other ply. During the mechanical combination, the plies may be combined by knurling, or by compression, or by embossing. Embossing is a deformation in the thickness of the ply or of the multiple plies. It results in a ply having a particular relief or indentation. The thickness of the ply or of the multiple plies is increased after embossing compared with its initial thickness.

The document U.S. Pat. No. 7,497,923 describes multi-ply tissue products having greater tactile sensation and resiliency in hand. The tissues may have a thickened and reduced density middle layer. The tissues may serve as applicators for chemical agents to be released during use of the tissue. A tissue having an improved tactile impression to the consumer, with enhanced resilience and high external bulk is disclosed. In one embodiment, a multi-ply structure having at least three plies is desirable. A middle or intermediate ply has an increased thickness and a greater bulk. In general, the exterior plies of the tissue are smooth and desirable to the consumer.

There is a need to improve the thickness, softness, bulkiness, absorption capacity and strength of the multi-ply tissue products. Further, this should be obtained by using less paper fibers resulting in economical and environmental positive aspects.

SUMMARY

It is desired to have a hybrid multi-ply tissue paper product that overcomes the drawbacks of the prior art multi-ply tissue paper products, and in particular provide a product thicker than prior art multi-ply tissue paper products for a less, at least a similar weight and using less paper fibers.

According to one aspect, there is provided a hybrid multi-ply tissue paper product including at least three plies made of tissue paper base-sheet, wherein:

- at least one ply is a structured ply produced by a structuring manufacturing method, the structured ply comprising including a structured back face;
- at least another ply is a wet pressed ply produced by a wet press manufacturing method;

wherein the structured ply is positioned and orientated with respect to the at least two other plies such that the structured back face of the structured ply is facing the at least two other plies so as to dampen a two-sidedness effect related to the structured back face.

The first wet pressed ply may include a first microstructure pattern with first protuberances.

The second wet pressed ply may include a second microstructure pattern with second protuberances.

The microstructure patterns may include protuberances of substantially identical heights.

The microstructure patterns may include a combination of protuberances with a first height and protuberances with a second height.

The second height may approximately be from 1 to 2 times greater than the first height.

The protuberances of the microstructure patterns may be chosen among the group of microstructure patterns comprising corrugations, undulations, wave-like profiles, pyramid or cone based micro-embossments, truncated pyramid or truncated cone micro-embossments.

The wet pressed plies may be bonded together according to a nested flat internal ply manufacturing process.

The through air dried ply may further include a temporary wet strength chemical agent.

The wet pressed ply may further include a temporary wet strength chemical agent.

The structured ply may be through air dried ply produced by a through air drying TAD, or an advanced tissue molding system ATMOS, or an energy efficient technologically advanced drying eTAD manufacturing method, and the wet pressed ply may be a conventional wet pressed ply produced by a conventional wet press CWP manufacturing method.

According to another aspect, there is provided a method for manufacturing hybrid multi-ply tissue paper product including at least three plies made of tissue paper base-sheet, wherein the manufacturing method includes:

manufacturing at least one ply as a structured ply produced by a structuring manufacturing method, the structured ply including a structured back face;

manufacturing at least another ply as a wet pressed ply produced by a wet press manufacturing method;

wherein the manufacturing method further includes positioning and orienting the structured ply with respect to the at least two other plies such that the structured back face of the structured plies is facing the at least two other ply so as to dampen a two-sidedness effect related to the structured back face.

According to a further aspect, there is provided a roll of sheet material comprising including a hybrid multi-ply tissue paper product of the invention wound onto a core.

According to still a further aspect, there is provided a folded sheet material comprising including a hybrid multi-ply tissue paper product of the invention cut, stacked and folded into a package.

According to still a further aspect, there is provided a use of a hybrid multi-ply tissue paper product such as paper towel, toilet tissue rolls, bathroom tissue, wiping tissue, kitchen tissue rolls, facial tissue or handkerchiefs.

The hybrid multi-ply tissue paper product is balanced in term of bulkiness, sheet caliper, softness, resilience and absorbency. It is bulky, have excellent softness and much better absorbency, and results in good tactile impression while having a lower grammage compared to conventional multi-ply tissue paper products showing similar bulkiness and softness. Further, even with tissue paper of low grammage, the described product enables an efficient damping of the two-sidedness effect of the structured ply. Because of the low grammage, the described product further results in paper fiber savings. Thus, the hybrid multi-ply tissue paper product is ecological, at least reduces the impact of the paper industry onto the environment and further enables minimizing the cost of producing.

Other advantages will become apparent from the hereinafter description of certain embodiments of the invention.

BRIEF DESCRIPTION OF THE DRAWINGS

Embodiments of the invention are illustrated by way of examples and not limited to the accompanying drawings, in which like references indicate similar elements.

DETAILED DESCRIPTION OF PREFERRED EMBODIMENTS

FIGS. 1 to 10 are side cross-section views schematically illustrating the layer structure of the hybrid multi-ply tissue paper product.

Figure 1:
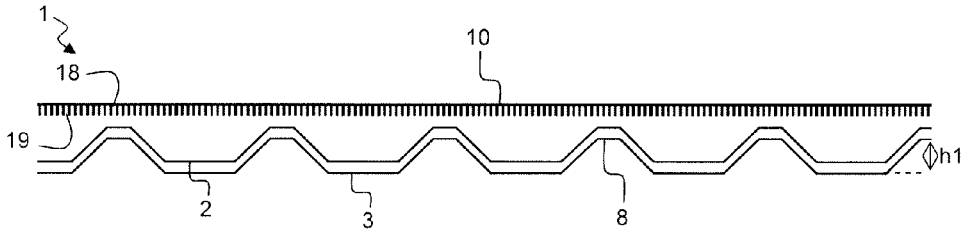
FIG. 1 is a side cross-section view in a hybrid multi-ply tissue paper product schematically illustrating a first embodiment including one structured ply and two wet pressed plies.

FIG. 1 schematically illustrates a first embodiment of the hybrid multi-ply tissue paper product 1. It includes three plies, namely two wet pressed plies 2 and 3, and one structured ply 10. Each of these plies is made of tissue paper base-sheet. Each of the two wet pressed plies 2 and 3 is produced by a wet press CWP manufacturing method. The structured ply 10 may be a through air dried ply produced by a through air drying TAD manufacturing method.

The structured ply 10 is unhandled and, thus, smooth and soft. The structured ply includes a structured back face 19 that is structured and rough. The structured ply includes a front face 18 that is smooth, flat and soft.

The two wet pressed plies 2 and 3 may be provided with a first microstructure pattern with first protuberances 8. For example, they are embossed together at a first height h1.

The structured ply 10 is positioned and orientated with respect to the two wet pressed plies 2 and 3 such that the structured back face 19 of the structured ply 10 is facing the two wet pressed plies 2 and 3. The front face 18 of the structured ply 10 is forming an external face of the hybrid multi-ply tissue paper product 1. It has been surprisingly found that such a position and orientation of the respective plies have the unexpected benefit of allowing a two-sidedness effect related to the TAD fabric structured back face to be dampened.

FIGS. 2 to 5 schematically illustrate various embodiments including one TAD ply, respectively two TAD plies in a central position between CWP plies.

Figure 2:
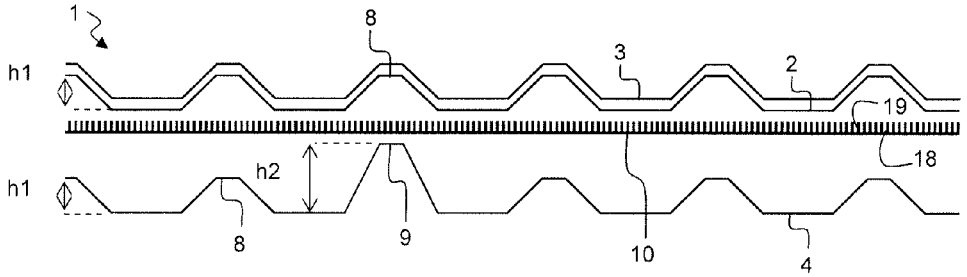
FIGS. 2 to 4 are side cross-section views in a hybrid multi-ply tissue paper product schematically illustrating a second, third and fourth embodiment including one structured ply in a central position between wet pressed plies, respectively.

FIG. 2 schematically illustrates a second embodiment of the hybrid multi-ply tissue paper product 1 of the invention. It includes four plies, namely three wet pressed plies 2, 3 and 4, and one through air dried ply 10. Each of these plies is made of tissue paper base-sheet. Each of the three wet pressed plies 2, 3 and 4 is produced by a wet press CWP manufacturing method. The through air dried ply 10 is produced by a through air drying TAD manufacturing method. The through air dried ply 10 includes a front face 18 and a back face 19. As a consequence of the through air drying TAD manufacturing method, in particular supporting the wet paper fibers on a fabric and drying by means of a current of hot air passing through the fabric and the paper fibers, the front face 18 is smooth and soft whereas the back face 19 is structured (reproducing the structure of the fabric) and rough. The TAD fabric structured back face 19 creates a two-sidedness effect that is undesirable to the consumer, in particular considering the tactile sensation. Alternatively to the through air drying TAD manufacturing method, other manufacturing method like the advanced tissue molding system ATMOS or the energy efficient technologically advanced drying eTAD manufacturing methods generate structured back face 19 creating a two-sidedness effect that is undesirable to the consumer.

The through air dried ply 10 is sandwiched between, on the one side, the two wet pressed plies 2 and 3, and, on the other side, the wet pressed ply 4. Thus, the through air dried ply 10 is in a central position between the CWP plies 2, 3 and 4.

The through air dried ply is unhandled (i.e. not embossed). Thus, the through air dried ply is smooth.

The two wet pressed plies 2 and 3 may be provided with a first microstructure pattern with first protuberances 8. For example, they are embossed together at a first height h1. The other wet pressed ply 4 may be provided with a second microstructure pattern combining first 8 and second 9 protuberances. For example, the second protuberances 9 may be obtained by embossing the wet pressed ply 4 at a second height h2 ranging from 1 to 2 times greater than the first height h1, for example 1.8 times greater. The first protuberances 8 of the wet pressed ply 4 may have a third height h3 that may be for example substantially identical to the first height h1. The density of the first protuberances 8 is greater than the density of the second protuberances 9.

The through air dried ply 10 is positioned and orientated with respect to the two wet pressed plies 2 and 3 in such a manner that the TAD fabric structured back face 19 of the through air dried ply 10 is facing said plies 2 and 3. The front face 18 is facing the other wet pressed ply 4.

As a consequence, the two-sidedness effect related to the TAD fabric structured back face is dampened by said two plies 2 and 3. Further, sandwiching the TAD ply between the two wet pressed plies 2 and 3 on one side and the wet pressed ply 4 on the other side enables obtaining a hybrid multi-ply tissue paper product having an important softness value.

Figure 3:
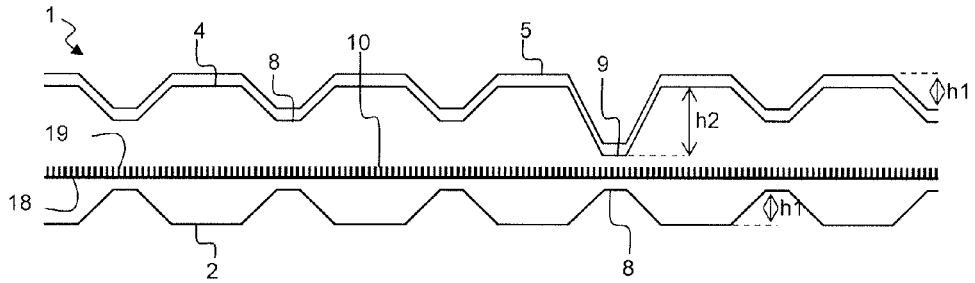

FIG. 3 schematically illustrates a third embodiment of the hybrid multi-ply tissue paper product 1. It includes four plies, namely a three wet pressed plies 2, 4 and 5 and one through air dried ply 10. The characterizing features of these plies have been explained with respect to the second embodiment.

The through air dried ply 10 is sandwiched between, on the one side, the wet pressed ply 2, and, on the other side, the two wet pressed plies 4 and 5. Thus, the through air dried ply 10 is in a central position between the CWP plies 2, 4 and 5.

The through air dried ply is unhandled (not embossed).

The wet pressed ply 2 may be provided with a first microstructure pattern with first protuberances 8. For example, it is embossed at a first height h1. The two other wet pressed plies 4 and 5 may be provided with a second microstructure pattern combining first 8 and second 9 protuberances. For example, the second protuberances may be obtained by embossing the wet pressed plies 4 and 5 at a second height h2 from 1 to 2 times greater than the first height h1, for example 1,8. The first protuberances 8 of the wet pressed plies 4 and 5 may have a third height h3 that may be for example substantially identical to the first height h1. The density of the first protuberances 8 is greater than the density of the second protuberances 9.

The through air dried ply 10 is positioned and orientated with respect to the two wet pressed plies 4 and 5 in such a manner that the TAD fabric structured back face 19 of the through air dried ply 10 is facing said plies 4 and 5. The front face 18 is facing the wet pressed ply 2.

Figure 4:
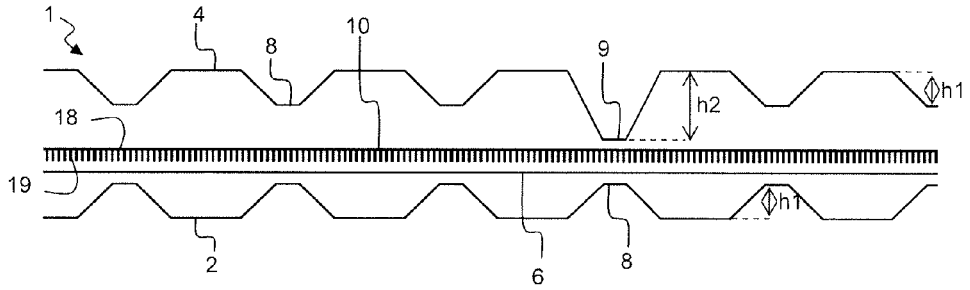

FIG. 4 schematically illustrates a fourth embodiment of the hybrid multi-ply tissue paper product 1. It includes four plies, namely three wet pressed plies 2, 4 and 6 and one through air dried ply 10. The characterizing features of these plies have been explained with respect to the second embodiment.

The through air dried ply 10 is sandwiched between, on the one side, the two wet pressed plies 2 and 6, and, on the other side, the wet pressed ply 4. Thus, the through air dried ply 10 is in a central position between the CWP plies 2, 4 and 6.

The through air dried ply 10 is unhandled (not embossed).

The wet pressed ply 2 may be provided with a first microstructure pattern with first protuberances 8. For example, it is embossed at a first height h1. The wet pressed ply 6 may be unhandled (not embossed). This enables avoiding nesting of the plies to a too important extend. The other wet pressed ply 4 may be provided with a second microstructure pattern combining first 8 and second 9 protuberances. For example, the second protuberances may be obtained by embossing the wet pressed ply 4 at a second height h2 ranging from 1 to 2 times greater than the first height h1, for example 1.8 times greater. The first protuberances 8 of the wet pressed ply 4 may have a third height h3 that may be for example substantially identical to the first height h1. The density of the first protuberances 8 is greater than the density of the second protuberances 9.

The through air dried ply 10 is positioned and orientated with respect to the two wet pressed plies 2 and 6 in such a manner that the TAD fabric structured back face 19 of the through air dried ply 10 is facing said plies 2 and 6. The front face 18 is facing the wet pressed ply 4.

Figure 5:
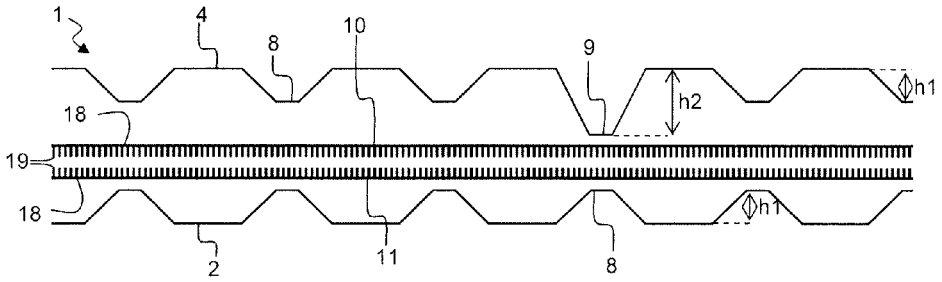
FIG. 5 is side cross-section view in a hybrid multi-ply tissue paper product schematically illustrating a fifth embodiment including two structured plies in a central position between wet pressed plies.

FIG. 5 is side cross-section view in a hybrid multi-ply tissue paper product schematically illustrating a fifth embodiment including two TAD plies 10, 11 in a central position between CWP plies 2, 4. It includes four plies, namely two wet pressed plies 2 and 4, and two through air dried ply 10 and 11. The characterizing features of these plies have been explained with respect to the second embodiment.

The two through air dried plies 10 and 11 are sandwiched between, on the one side, the wet pressed ply 2, and, on the other side, the wet pressed ply 4. Thus, the through air dried plies 10 and 11 are in a central position between the CWP plies 2 and 4.

The through air dried plies 10 and 11 are unhandled (not embossed).

The wet pressed ply 2 may be provided with a first microstructure pattern with first protuberances 8. For example, it is embossed at a first height h1. The other wet pressed ply 4 may be provided with a second microstructure pattern combining first 8 and second 9 protuberances. For example, the second protuberances may be obtained by embossing the wet pressed ply 4 at a second height h2 ranging from 1 to 2 times greater than the first height h1, for example 1.8 times greater. The first protuberances 8 of the wet pressed ply 4 may have a third height h3 that may be for example substantially identical to the first height h1. The density of the first protuberances 8 is greater than the density of the second protuberances 9.

Both through air dried ply 10 and 11 are positioned and orientated with respect to each other and to the two wet pressed plies 2 and 4 in such a manner that the respective TAD fabric structured back faces 19 of the through air dried plies 10 and 11 are facing each other and also said plies 2 and 4. Each front face 18 of the through air dried plies 10 and 11 is facing the respective wet pressed ply 2 and 4, respectively.

In all the hereinbefore presented embodiments, the three or four plies may be coupled together by an adhesive at the level of at least the tips 8 and 9 of the first and second protuberances that are facing each other, respectively. This aspect will be described in more details with reference to FIG. 11.

FIGS. 6 to 10 schematically illustrate various embodiments including one TAD ply, respectively two TAD plies, in an external position with respect to CWP plies.

Figure 6:
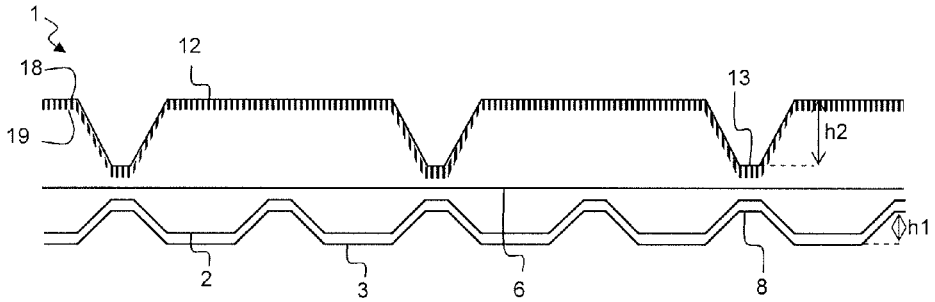
FIGS. 6 and 7 are side cross-section views in a hybrid multi-ply tissue paper product schematically illustrating a sixth and seventh embodiment including one structured ply in an external position with respect to wet pressed plies, respectively.
Figure 7:
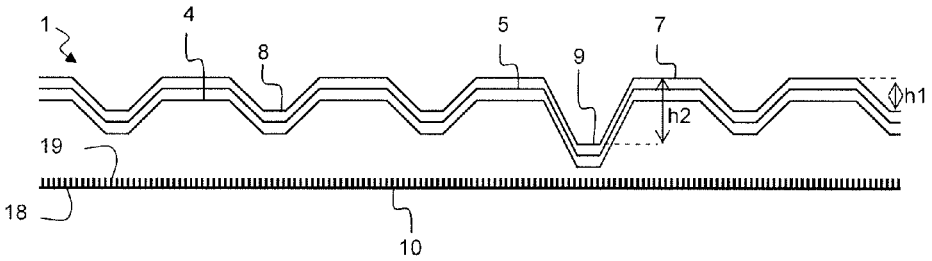

FIGS. 6 and 7 are side cross-section views in a hybrid multi-ply tissue paper product 1 schematically illustrating a sixth and seventh embodiments including one TAD ply in an external position with respect to the CWP plies, respectively.

FIG. 6 schematically illustrates a sixth embodiment of the hybrid multi-ply tissue paper product 1. It includes four plies, namely three wet pressed plies 2, 3 and 6, and one through air dried ply 12. The characterizing features of these plies have been explained with respect to the second embodiment.

The through air dried ply 12 is on the one side, the three wet pressed plies 2, 3 and 6 are on the other side. Thus, the through air dried ply 12 is in an external position with respect to the CWP plies 2, 3 and 6.

The two wet pressed plies 2 and 3 may be provided with a first microstructure pattern with first protuberances 8. For example, they are embossed together at a first height h1. The wet pressed ply 6 may be unhandled (not embossed). The through air dried ply may be provided with a second microstructure pattern with second protuberances 13. The through air dried ply 12 being naturally thick, embossing the through air dried ply does not confer any further thickness but rather enables providing aesthetic effect to the ply. For example, it is embossed at a second height h2 ranging from 1 to 2 times greater than the first height h1, for example 1.8 times greater. The density of the first protuberances 8 is greater than the density of the second protuberances 13.

The through air dried ply 12 is positioned and orientated with respect to said wet pressed plies 2, 3 and 6 in such a manner that the TAD fabric structured back face 19 of the through air dried ply 12 is facing said plies 2, 3 and 6. The front face 18 is forming an external face of the hybrid multi-ply tissue paper product 1.

As an alternative, this embodiment may be modified by not embossing the wet pressed ply 2, and thus providing two smooth and flat wet pressed plies 2 and 6 between the through air dried ply 12 and the embossed wet pressed plies 3. The flat wet pressed ply 2, respectively plies 2 and 6, enables giving thickness to the tissue paper product by avoiding nesting the wet pressed plies 3 into the through air dried ply 12.

FIG. 7 schematically illustrates a seventh embodiment of the hybrid multi-ply tissue paper product 1. It includes four plies, namely three wet pressed plies 4, 5 and 7, and one through air dried ply 10. The characterizing features of these plies have been explained with respect to the second embodiment.

The through air dried ply 10 is on the one side, the three wet pressed plies 4, 5 and 7 are on the other side. Thus, the through air dried ply 10 is in an external position with respect to the CWP plies 4, 5 and 7.

The three wet pressed plies 4, 5 and 7 may be provided with a microstructure pattern combining first 8 and second 9 protuberances. For example, the first protuberances 8 may be obtained by embossing the wet pressed plies 4, 5 and 7 at a first height h1. The second protuberances 9 may be obtained by embossing the wet pressed plies 4, 5 and 7 at a second height h2 from 1 to 2 times greater than the first height h1. The density of the first protuberances 8 is greater than the density of the second protuberances 9.

The through air dried ply 10 may be unhandled (not embossed).

The through air dried ply 10 is positioned and orientated with respect to said wet pressed plies 4, 5 and 7 in such a manner that the TAD fabric structured back face 19 of the through air dried ply 10 is facing said plies 4, 5 and 7. The front face 18 is forming an external face of the hybrid multi-ply tissue paper product 1.

Figure 8:
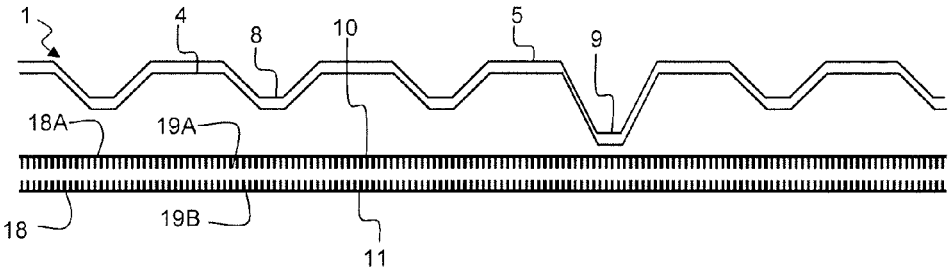
FIGS. 8 to 10 are side cross-section views in a hybrid multi-ply tissue paper product schematically illustrating a eighth, ninth and tenth embodiment including two structured plies in an external position with respect to wet pressed ply/plies, respectively.
Figure 9:
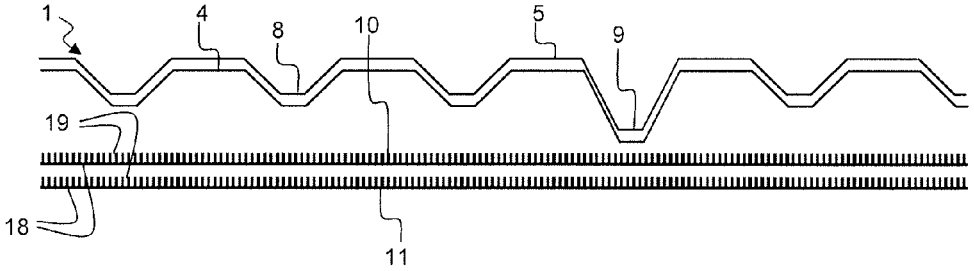

FIGS. 8 and 9 are side cross-section views in a hybrid multi-ply tissue paper product 1 schematically illustrating an eighth and ninth embodiment including two TAD plies in an external position with respect to CWP plies, respectively.

Both embodiments include four plies, namely two wet pressed plies 4 and 5, and two through air dried ply 10 and 11. The characterizing features of these plies have been explained with respect to the second embodiment.

The two wet pressed plies 4 and 5 may be provided with a microstructure pattern combining first 8 and second 9 protuberances. For example, the first protuberances 8 may be obtained by embossing the wet pressed plies 4 and 5 at a first height h1. The second protuberances 9 may be obtained by embossing the wet pressed plies 4 and 5 at a second height h2 ranging from 1 to 2 times greater than the first height h1, for example 1.8 times greater. The density of the first protuberances 8 is greater than the density of the second protuberances 9.

The through air dried plies 10 and 11 may be unhandled (not embossed). Alternatively, at least one of the through air dried plies 10 and 11 may be macro- or micro-embossed (not shown).

According to the eighth embodiment depicted in FIG. 8, the through air dried plies 10 and 11 are positioned in vis-á-vis with respect to each other. More precisely, the first through air dried ply 10 is positioned and orientated with respect to the second through air dried ply 11 in such a manner that the TAD fabric structured back face 19A of the through air dried ply 10 is facing the TAD fabric structured back face 19B of the other ply 10. The front face 18A of the first through air dried ply 10 is facing the wet pressed plies 4 and 5.

According to the ninth embodiment depicted in FIG. 9, the through air dried plies 10 and 11 are positioned in stack. More precisely, the through air dried plies 10 and 11 are positioned and orientated with respect to the two wet pressed plies 4 and 5 in such a manner that both TAD fabric structured back faces 19 of the through air dried plies 10 and 11 are facing said plies 4 and 5. The front face 18 is forming an external face of the hybrid multi-ply tissue paper product 1.

Figure 10:
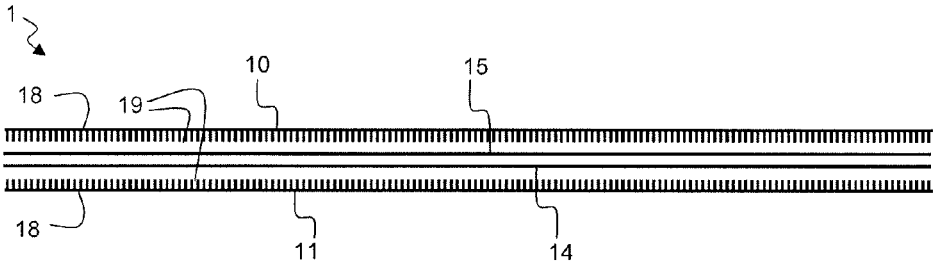

FIG. 10 schematically illustrates a tenth embodiment of the hybrid multi-ply tissue paper product 1. It includes four plies, namely two TAD plies 10 and 11, each being in an external position with respect to CWP plies 14 and 15. The characterizing features of these plies have been explained with respect to the second embodiment.

The wet pressed plies 14 and 15 are sandwiched between, on the one side, the first through air dried ply 10, and, on the other side, the second through air dried ply 11. Thus, the wet pressed plies 14 and 15 are in a central position between the through air dried plies 10 and 11.

The through air dried plies 10 and 11 are unhandled (not embossed).

The wet pressed plies 14 and 15 may be unhandled (not embossed). Alternatively, the wet pressed plies 14 and 15 may be embossed with microstructure pattern combining first and second protuberances as described with respect to the other embodiments.

Each through air dried ply 10, respectively 11, is positioned and orientated with respect to the two wet pressed plies 14 and 15 in such a manner that the TAD fabric structured back face 19 of the respective through air dried ply 10, respectively 11, is facing said plies 14 and 15 and also the other through air dried ply 11, respectively 10. The front faces 18 of the through air dried plies 10 and 11 are forming the external faces of the hybrid multi-ply tissue paper product 1.

In all the hereinbefore presented embodiments, at least one of the through air dried ply or the wet pressed ply may be treated with a temporary wet strength chemical agent.

The following Table presents the various characteristics that have been measured for various multi-ply tissue paper products. Among those characteristics, the purchasing intent PI is a value indicating the intention of purchase of the concerned tissue paper product obtained from a panel of consumers. Further, the softness is a value obtained from a panel of consumers. The grammage is measured according to the standard EN ISO 12625-6:2005. The thickness is measured according to the standard EN ISO 12625-3:2005. The MD strength and CD strength (dry strength) are measured according to the standard EN ISO 12625-4:2005. The absorption is measured according to the standard EN ISO 12625-8:2006. In the first column, the first, second and third lines relate to known three plies, four plies and five plies CWP tissue paper products, respectively. The five plies CWP tissue paper product constitutes a reference in term of thickness, softness and purchasing intent. In the first column, the other lines relates to the various embodiments depicted in FIGS. 2 to 7 and 10. The eighth and ninth lines relate to the embodiment of FIG. 6, wherein in a first case, the hybrid multi-ply tissue paper product includes one CWP ply of low strength and two CWP plies of high strength, and, in the second case, the hybrid multi-ply tissue paper product includes three CWP plies of low strength.

TABLE

| | Measurements: | | | | | | |
|---|---|---|---|---|---|---|---|
| | Grammage | Thick-ness | MD strength | CD strength | Soft-ness | Absorption | PI |
| 3 plies CWP | 52.7 | 0.5 | 342 | 150 | 1.5 | 5.3 | 3.88 |
| 4 plies CWP | 63.2 | 0.58 | 410 | 121 | 1.6 | 6.5 | 3.95 |
| 5 plies CWP | 90.5 | 0.78 | 460 | 230 | 1.8 | 11.7 | 4.20 |
| FIG. 2 | 61.5 | 0.7 | 300 | 160 | 2 | 8.5 | 4.24 |
| FIG. 3 | 69 | 0.7 | 230 | 150 | 2 | 9.5 | 4.21 |
| FIG. 4 | 65.5 | 0.7 | 300 | 190 | 2 | 8.5 | 4.23 |

TABLE-continued

| | Measurements: | | | | | | |
|---|---|---|---|---|---|---|---|
| | Grammage | Thick-ness | MD strength | CD strength | Soft-ness | Absorption | PI |
| FIG. 5 | 65.5 | 0.7 | 310 | 150 | 2.1 | 10 | 4.28 |
| FIG. 6 | 70 | 0.63 | 480 | 300 | 1.9 | 8.8 | 4.24 |
| FIG. 6 altern. | 63.5 | 0.66 | 210 | 135 | 2.1 | 8.8 | 4.22 |
| FIG. 7 | 60.5 | 0.64 | 200 | 120 | 2 | 8.5 | 4.19 |
| FIG. 10 | 67.5 | 0.61 | 250 | 170 | 2 | 10.5 | 4.26 |

Units: grammage in g/m$^2$, thickness in mm/sheet, machine direction MD strength in N/m, cross machine CD strength in N/m, softness without unit, absorption in g/sheet and purchasing intent PI without unit.

The second embodiment (depicted in FIG. 2) represents a hybrid multi-ply tissue paper product having one of the highest purchasing intent PI at 4.24, one of the highest softness at 2, a thickness of 0.7 mm/sheet and a grammage of 61.5 g/m$^2$. These are characteristics close or better than the five plies reference product while having a grammage 30% lower. This means that a better, or at least equivalent product is obtained with respect to thickness, softness and purchasing intent PI while using less paper fiber than the reference product (except for MD and CD strength characteristics). Thus, by using less paper fiber, the hybrid multi-ply tissue paper product results in an ecological and cost effective product. Further, the second embodiment characteristics are better than the four plies reference product in particular with respect to the thickness, absorption, softness and purchasing intent PI (except for MD and CD strength characteristics). Furthermore, the other embodiments also represent a better, or at least equivalent, product than the five-ply reference product. Furthermore, the embodiment enables an efficient damping of the two-sidedness effect of the structured ply even if a coarser fabric (thus generating an important two-sidedness effect) is used during the through air drying TAD paper making process.

Figure 11:
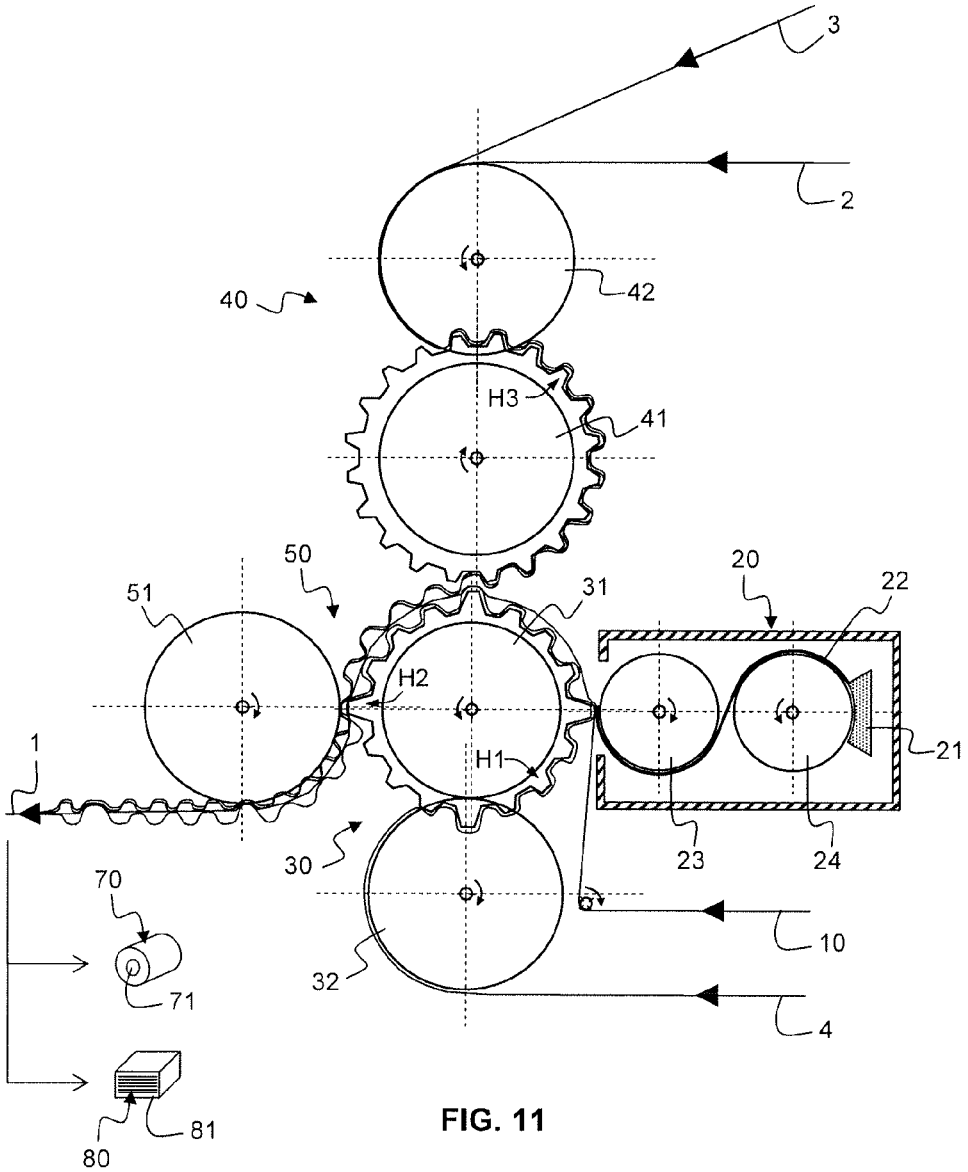
FIG. 11 schematically and partially illustrates an example of a converting assembly and method for manufacturing the hybrid multi-ply tissue paper product according to the second embodiment.

FIG. 11 schematically and partially illustrates an example of a converting assembly and method for manufacturing the hybrid multi-ply tissue paper product according to the second embodiment (depicted in FIG. 2). The converting assembly includes a glue dispenser 20, a first embossing unit 30, a second embossing unit 40 and a joining unit 50. The converting assembly and the converting method for manufacturing such a hybrid multi-ply tissue paper product that will be explained in details hereinafter is based on a facility designed for manufacturing a conventional, nested two or three ply paper product without requiring substantial changes in components or adjustments (nested flat internal ply process as described in EP 1 081 284). Thus, manufacturing the hybrid multi-ply tissue paper product on an existing converting assembly is particularly cost effective.

The first embossing unit 30 an engraved cylinder 31 and a mating rubber cylinder 32, both rotating in opposite directions. The cylinder 31 is engraved with a microstructure pattern combining first embossing tips of height Ill and second embossing tips of height H2. The first embossing tips are shallower than the second embossing tips. The first external ply 4 is embossed in the first embossing apparatus 30. The engraved cylinder 31 enables performing a double-level engraving. The obtained embossed first external ply 4 includes at least partly high discrete protuberances of height h2 (for example discrete truncated protuberances and/or linear protuberances such as flowers), and low protuberances of height h1 (for example discrete truncated protuberances). The heights h1 and h2 depend on the heights H1 and H2 of the engravings and also on the other embossing parameters, namely pressure, rubber quality, etc . . . .

The microstructure pattern may include corrugations, undulations, wave-like profiles, pyramid or cone based micro-embossments, truncated pyramid or truncated cone micro-embossments.

As an example, the first embossing tips on the cylinder 31 have an engraving height H1 between 0.2 and 2 mm and the second embossing tips on the cylinder 31 have an engraving height H2 such that the height difference H2–H1 is between 0.1 and 0.7 mm. The microstructure patterns may have a density larger than 20 protuberances/$cm^2$.

The through air dried ply 10 is superposed on the protuberances of the embossed first external ply 4 at the level of the engraved cylinder 31. The through air dried ply 10 fits closely onto the high protuberances of the embossed first external outer ply 4. It further remains substantially planar between two consecutive high protuberances. Alternatively, it may be supported by the planar areas of the shallow protuberances.

At the place of said superposition between the embossed first external ply 4 and the through air dried ply 10, a glue dispenser 20 applies an adhesive 22 to the external side of the through air dried ply 10. The adhesive 22 may be applied to the external side of the through air dried ply 10 opposite the distal areas of the protuberances of height h2 of the embossed first external ply 4.

The glue dispenser 20 includes a vat 21, an applicator cylinder 23 and a dipping cylinder 24. The applicator cylinder 23 abuts the superposed through air dried ply 10 and the embossed first external ply 4 against the engraved cylinder 31. The dipping cylinder 24 picks up the adhesive 22 in the vat 21 and transfers the adhesive 22 to the applicator cylinder 23. The applicator cylinder 23 is arranged to exercise a determined pressure on the engraved cylinder 31 at the distal area of the protuberances of height h2 of the embossed first external ply 4. At said determined pressure, the adhesive 22 crosses the through air dried ply 10. In this manner, the through air dried ply 10 is also slightly embossed. Alternatively, the applicator cylinder 23 may be fitted with an engraved surface so as to apply the adhesive 22 only to part of the protuberances. This enables providing flexibility to the hybrid multi-ply tissue paper product 1.

Because the gluing areas are limited to the distal planar areas of the high protuberances of the embossed first external ply 4, the resulting stiffness of the hybrid multi-ply tissue paper product 1 can be predetermined. Thus, the resulting stiffness may be adjusted. FIG. 11 only illustrates a particular example including a rate of one high protuberance for three shallow protuberances.

The adhesive 22 may be a polyvinyl acetate glue or a hot-melt glue. The adhesive may be diluted in water according to a proportion enabling an appropriate transfer to the various plies. Substantially simultaneously to the formation of the embossed first external ply 4 and the through air dried ply 10, the two other wet pressed plies 2 and 3 are embossed together in the second embossing apparatus 40.

The second embossing unit 40 includes an engraved cylinder 41 and a mating rubber cylinder 42, both rotating in opposite directions. The cylinder 41 is engraved with a microstructure pattern having embossing tips of height H3. The height H3 may be substantially equal to the height H1.

The resulting second embossed external plies 2 and 3 include at least partly low discrete protuberances of height h1. The second engraved cylinder 41 may also include an aesthetic pattern (for example flowers).

Subsequently, the embossed first external ply 4 and the through air dried ply 10, and the embossed second external plies 2 and 3 are joined together in a nesting mode in the joining unit 50.

The joining unit 50 includes a marrying cylinder 51 working in cooperation with the engraved cylinder 31 of the first embossing unit 30. The surface of the marrying cylinder 51 may be smooth. Alternatively, it may also be engraved and may include gaps in order to adjust the surface of joining and the final hybrid multi-ply tissue paper product 1 flexibility.

The joining of the first embossed external ply 4 fitted with the glue-coated through air dried ply 10 to the second embossed external plies 2 and 3 is carried out in such a manner that:

one the one hand, the distal areas of the high protuberances of the first embossed external ply 4 nest at least partly with the distal areas of the protuberances of the second embossed external plies 2 and 3, and on the other hand, sufficient pressure is applied to bond the four plies 2, 3, 4 and 10 with the help of the adhesive 22.

As an alternative to the glue dispenser 50 as illustrated in FIG. 11, the adhesive (e.g. a hot melt glue, an aqueous glue, etc . . . ) may be sprayed by appropriate means on each of the sides of the through air dried ply 10 before the through air dried ply 10 is joined with the other external plies.

Then, the hybrid multi-ply tissue paper product may be wound onto a core 71 as a roll of sheet material 70, or may be stacked and folded into a package 81 as a folded sheet material 80. These operations are not germane to the present invention and will not be further described. The hybrid multi-ply tissue paper product may be used as paper towel, toilet tissue rolls, bathroom tissue, wiping tissue, kitchen tissue rolls, facial tissue or handkerchiefs, etc . . . .

The converting assembly and method hereinbefore described can be easily adapted to manufacture the various embodiments depicted in FIGS. 1 and 3 to 10. Such adaptation may include changing the order and nature of the various plies, the microstructure pattern on the first engraved cylinder 31 and the second engraved cylinder 41. Thus, the corresponding converting assemblies, methods and their variations will not be further described as they are based on the converting assembly and method depicted in FIG. 11.

The drawings and their descriptions hereinbefore illustrate rather than limit the invention.

Though the invention has been described with respect to various embodiments of hybrid multi-ply tissue paper products including three plies, and four plies, these are not limitative examples. The skilled person will readily recognize that the hybrid multi-ply tissue paper product may include more plies, e.g. five, six, seven, etc . . . provided that the structured back face of the structured ply is facing the at least two other plies so as to dampen a two-sidedness effect related to the structured back face.

The numbers, densities, positions and shapes of the micro-embossments in the depicted embodiments are non-limitative examples. The skilled person will readily recognize that these numbers, densities, positions and shapes may be changed if desired or deemed necessary with respect to, for example, the desired aesthetic effect to be achieved by the hybrid multi-ply tissue paper products.

Any reference sign in a claim should not be construed as limiting the claim. The word "comprising" does not exclude the presence of other elements than those listed in a claim.

The word "a" or "an" or "at least one" preceding an element does not exclude the presence of a plurality of such element.

The invention claimed is:

1. A hybrid multi-ply tissue paper product comprising:

a first ply that is a structured ply that includes a front face that is smooth and a back face that is rough, wherein the structured ply is produced by a structuring manufacturing method selected from the group consisting of: through air dried ply produced by through air drying (TAD), an advanced tissue molding system (ATMOS), or an energy efficient technologically advanced drying (eTAD) manufacturing method, the structured ply comprising a structured back face;

a second ply that is a wet pressed ply produced by a wet press manufacturing method; and a third ply that is a wet pressed ply produced by the wet press manufacturing method;

wherein the first ply is positioned and orientated with respect to at least one ply selected from the second, and third plies, such that the back face of the first ply faces the least one of one ply selected from the second and third plies so as to dampen a two-sidedness effect related to the back face of the first ply.

2. The hybrid multi-ply tissue paper product of claim 1, wherein the second ply comprises a first microstructure pattern with first protuberances.

3. The hybrid multi-ply tissue paper product of claim 2, wherein the third ply comprises a second microstructure pattern with second protuberances.

4. The hybrid multi-ply tissue paper product of claim 3, wherein the first and second microstructure patterns comprise first and second protuberances of substantially identical heights.

5. The hybrid multi-ply tissue paper product of claim 3, wherein the first and second microstructure patterns comprise a combination of the first protuberances with a first height and the second protuberances with a second height.

6. The hybrid multi-ply tissue paper product of claim 5, wherein the second height is from approximately 1 to 2 times greater than the first height.

7. The hybrid multi-ply tissue paper product according to claim 3, wherein the first and second protuberances of the first and second microstructure patterns are chosen among the group consisting of corrugations, undulations, wave-like profiles, pyramid micro-embossments, cone based micro-embossments, truncated pyramid micro-embossments, and truncated cone micro-embossments.

8. The hybrid multi-ply tissue paper product according to claim 1, wherein the second ply and third ply are bonded together according to a nested flat internal ply manufacturing process.

9. The hybrid multi-ply tissue paper product according to claim 1, wherein the first ply further comprises a temporary wet strength chemical agent.

10. The hybrid multi-ply tissue paper product according to claim 1, wherein at least the second ply or the third ply further comprises a temporary wet strength chemical agent.

11. The hybrid multi-ply tissue paper product according to claim 1, wherein the second ply and the third ply are conventional wet pressed plies produced by a conventional wet press CWP manufacturing method.

12. A roll of sheet material comprising a hybrid multi-ply tissue paper product according to claim 1 wound onto a core.

13. A folded sheet material comprising a hybrid multi-ply tissue paper product according to claim 1 cut, stacked and folded into a package.

14. The hybrid multi-ply tissue paper of claim 1, wherein the hybrid multi-ply tissue paper product has a machine direction strength less than 500 N/m and a cross direction strength of 300 N/m or less.

15. A method for manufacturing hybrid multi-ply tissue paper product comprising at least three plies made of tissue paper base-sheet, wherein the manufacturing method comprises:

manufacturing at least one ply as a structured ply produced by a structuring manufacturing method through air dried ply produced by through air drying (TAD), an advanced tissue molding system (ATMOS), or an energy efficient technologically advanced drying (eTAD) manufacturing method, the structured ply comprising a structured back face;

manufacturing two plies as a wet pressed plies produced by a wet press manufacturing method; and positioning and orienting the structured ply with respect to the at least two other plies such that the structured back face of the structured ply is facing the at least two other plies so as to dampen a two-sidedness effect related to the structured back face.

* * * * *